United States Patent [19]

Andrews

[11] Patent Number: 4,825,476

[45] Date of Patent: May 2, 1989

[54] ARTICULATED HEAD, NECK AND SHOULDER PROTECTIVE DEVICE

[76] Inventor: Donald L. Andrews, 5802 Sanibel Captiva Rd., Sanibel, Fla. 33957

[21] Appl. No.: 117,842

[22] Filed: Nov. 9, 1987

[51] Int. Cl.[4] ..... A63B 71/10; A63B 71/12

[52] U.S. Cl. ..... 2/421; 2/2; 2/425

[58] Field of Search ..... 2/2, 2.1 A, 5, 6, 7, 2/268, 410, 425, 421

[56] References Cited

U.S. PATENT DOCUMENTS

| | | | |
|---|---|---|---|
| 3,030,626 | 4/1962 | Shepard | 2/2.1 A |
| 3,134,106 | 5/1964 | Shaffer et al. | 2/2 |
| 3,559,209 | 2/1971 | Vail | 2/6 X |
| 4,185,331 | 1/1980 | Nomiyama | 2/425 X |

FOREIGN PATENT DOCUMENTS

| | | | |
|---|---|---|---|
| 210981 | 2/1987 | European Pat. Off. | 2/410 |
| 1098374 | 1/1968 | United Kingdom | 2/6 |

*Primary Examiner*—Wm. Carter Reynolds
*Attorney, Agent, or Firm*—Merrill N. Johnson

[57] ABSTRACT

An articulated head, neck and shoulder protective device particularly adapted for use by football players. The device includes a shoulder protector having an annular track at its center large enough for the wearer's head to pass through. A helmet assembly is rotatably mounted upon the annular track. The helmet assembly includes an annular ring which rides on the shoulder protector's annular track, a circular helmet carrying housing having two upwardly projecting flanges and a helmet pivotably mounted on the two flanges of the helmet carrying housing.

7 Claims, 3 Drawing Sheets

FIG. 1
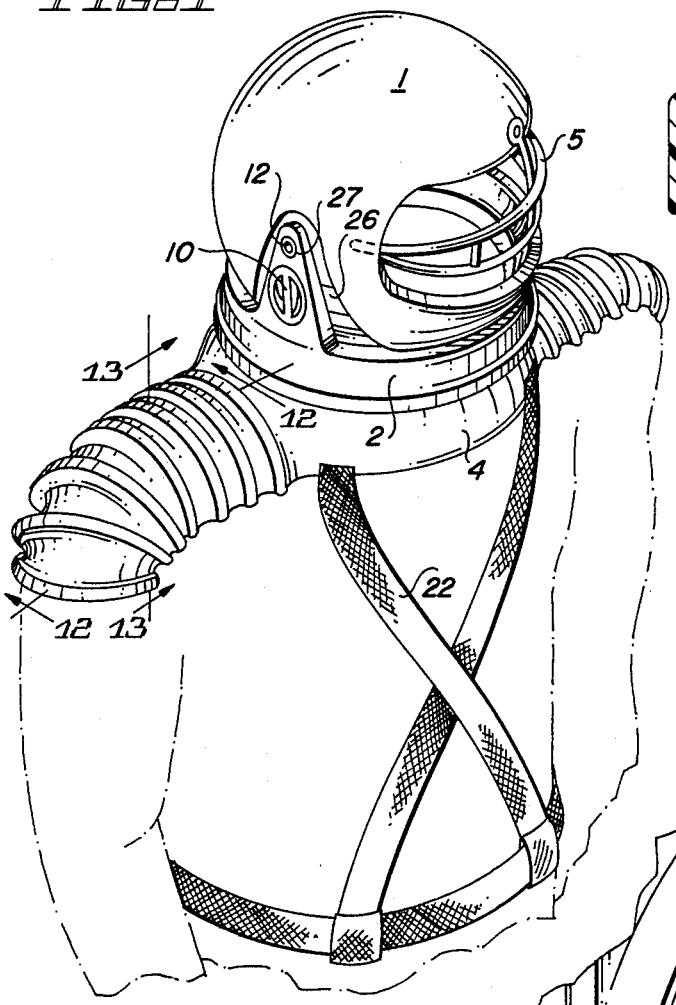
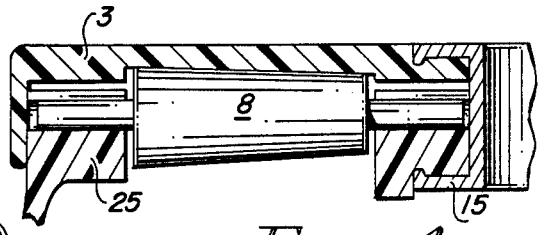
FIG. 4
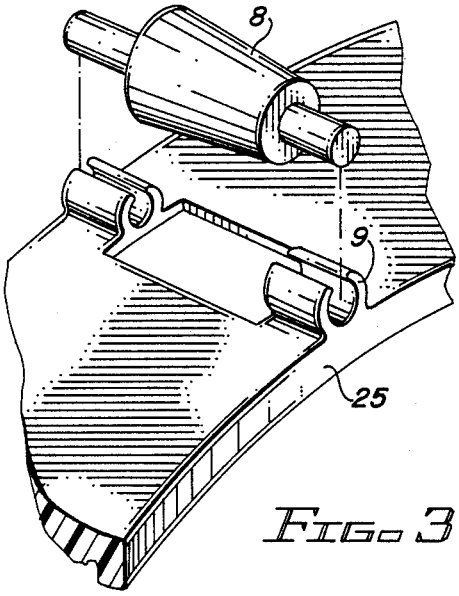
FIG. 3
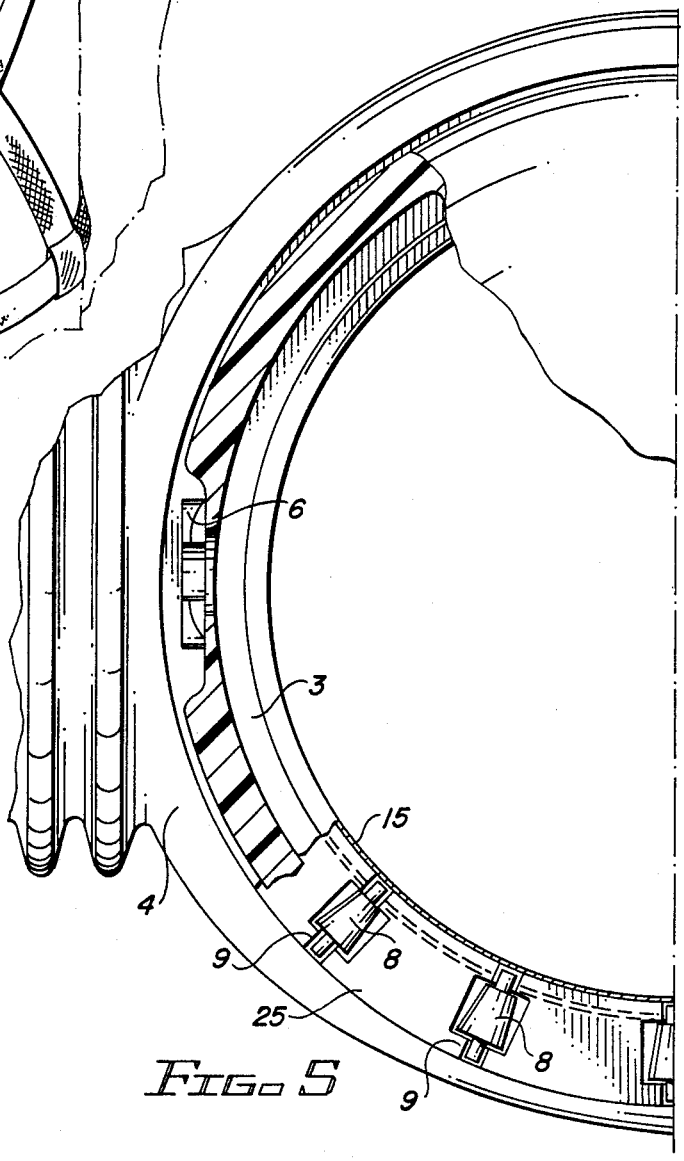
FIG. 5

FIG. 2
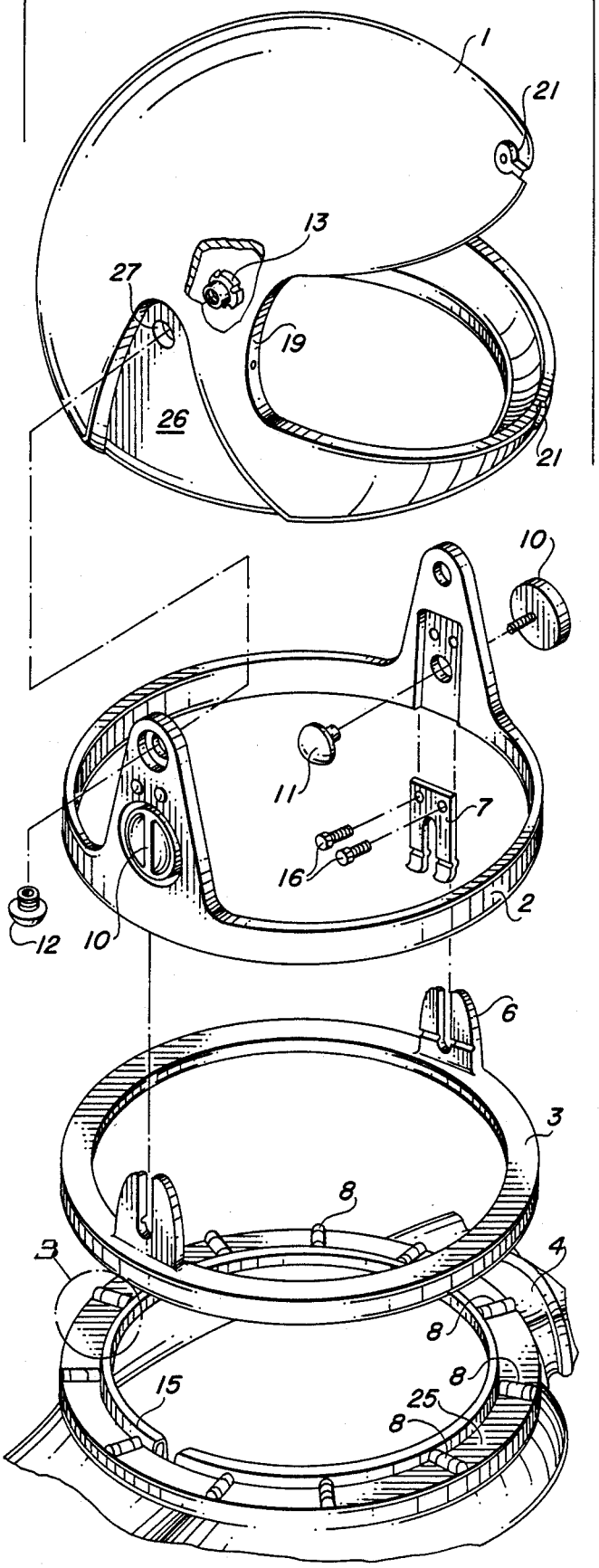
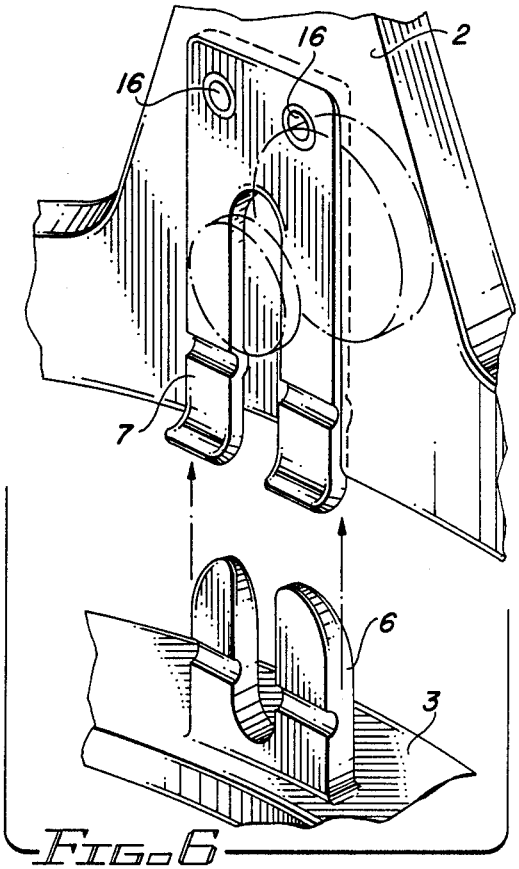
FIG. 6
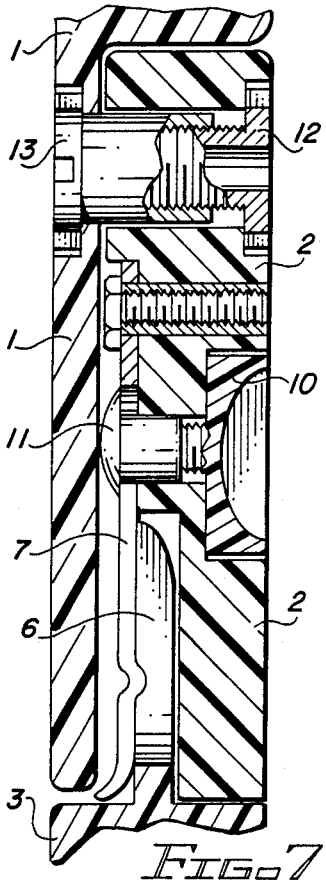
FIG. 7

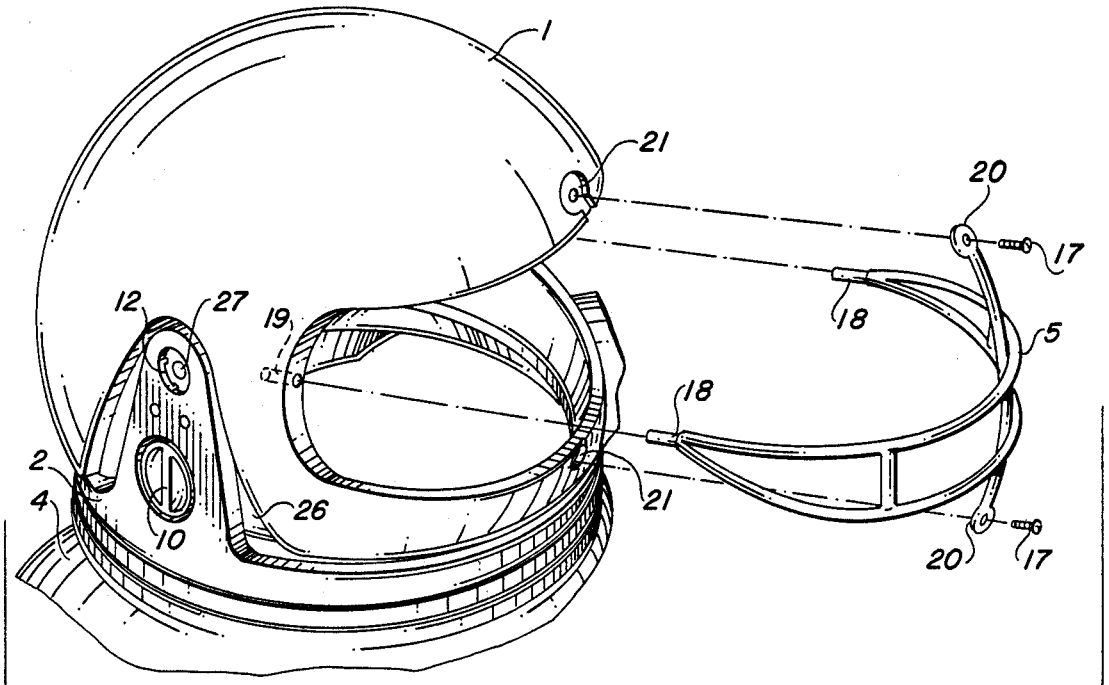
FIG. 8
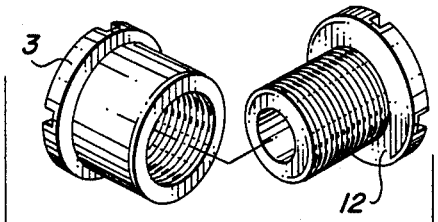
FIG. 9
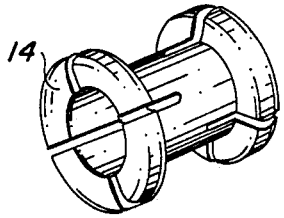
FIG. 10
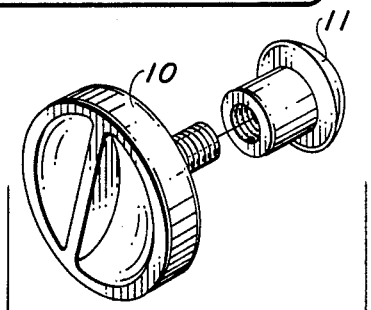
FIG. 11
FIG. 12
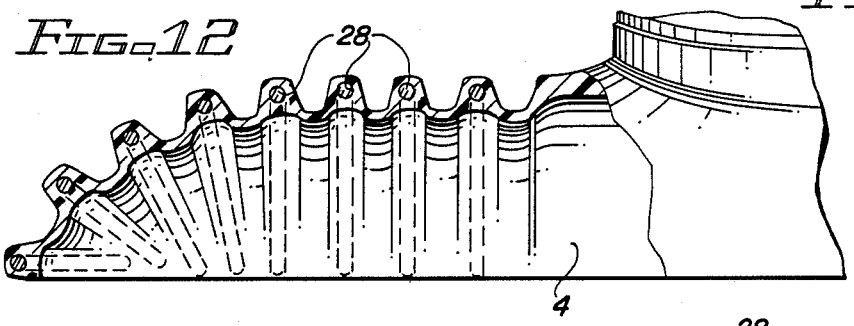
FIG. 15
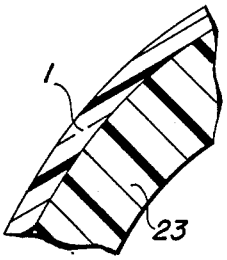
FIG. 13
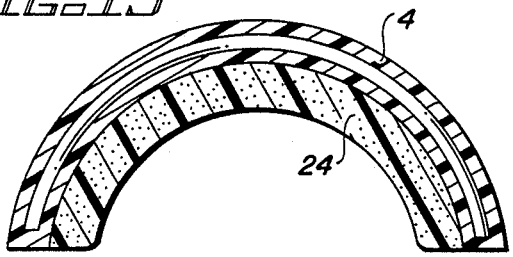
FIG. 14
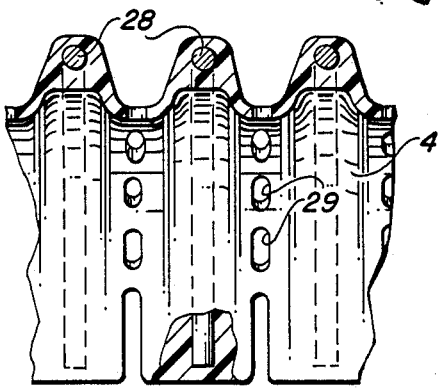

ARTICULATED HEAD, NECK AND SHOULDER PROTECTIVE DEVICE

BACKGROUND AND SUMMARY OF THE INVENTION

American football is a man-to-man collision sport and a variety of serious injuries to the head and neck can and do result from collisions on the football field and during practice. While conventional football helmets and shoulder pads do a relatively good job of protecting the head and shoulders of the player, they afford almost no protection to the neck and the most devastating injuries suffered by football players are neck and upper spinal injuries. These injuries can result in permanent paralysis or death.

A number of attempts have been made to improve the protection afforded the head and neck of football players. See, for example, Varteression U.S. Pat. No. 3,873,996 and Newman U.S. Pat. No. 4,219,193. While devices such as those shown in these patents offer some protection to a player's neck, the devices themselves could serve as a source of injury to other players. More importantly, such devices do not protect the player during a head-on collision.

It is a major object of my invention to provide adequate protection of the head, neck and shoulders of football players even during a head-on collision. A further object of my invention is to provide adequate protection without undue restriction of the player's head, neck, shoulders and arms and at the same time restricting excessive head movements which may result in serious injury.

After considerable experimentation and testing, I have invented a unique head, neck and shoulder protective device which provides adequate protection particularly of the player's neck even during a head-on collision. My device is made largely of molded high strength thermosetting materials and includes a shoulder protector having at its center an annular track which surrounds a hole large enough for the player's head to pass through. A helmet assembly is rotatably mounted on the annular track. The helmet assembly includes an annular ring rotatable upon the track, a circular helmet carrying housing which has two upwardly projecting flanges onto which a helmet is pivotably mounted.

Preferably the track upon which the annular ring rotates includes a plurality of conical rollers which fit into an annular groove in the bottom side of the annular ring, so as to provide almost frictionless rotation of the helmet assembly in response to sideways movements of the player's head.

The helmet, helmet carrying housing, shoulder protector and some other parts are preferably molded of a light weight high impact strength material such as boron or carbon fiber reinforced styrene or epoxy resin.

BRIEF DESCRIPTION OF THE DRAWING

Referring now to the attached drawing:

FIG. 1 is a preferred embodiment of my protective device worn by a football player.

FIG. 2 is an exploded view of the helmet, helmet carrying housing, annular ring, and the series of rollers mounted upon the track of the shoulder protector.

FIG. 3 is a detailed perspective view of one of the conical rollers shown in FIG. 2.

FIG. 4 is a detailed cross-sectional view of one of the rollers in FIGS. 2 and 3 showing the annular groove in the bottom side of the annular ring.

FIG. 5 is a top plan view partially broken away showing several rollers mounted on the track of the shoulder protector and one of the upwardly projecting flanges of the annular ring riding on the rollers of the track.

FIG. 6 is a detailed broken away side view of the connections between the annular ring and the helmet carrying housing.

FIG. 7 is a cross-sectional view taken through the interconnection of the annular ring, the helmet carrying housing and the helmet.

FIG. 8 is an exploded side view showing the mounting of the face mask onto the helmet.

FIGS. 9 and 10 show alternative forms of helmet pivot pins for connecting the helmet to the helmet carrying housing.

FIG. 11 shows the preferred form of fastener for securing the helmet housing to the rotatable ring.

FIG. 12 is a cross-sectional front elevation of one side of the shoulder protector shown in FIG. 1.

FIG. 13 is a cross-sectional side view of the shoulder protector shown in FIGS. 1 and 12.

FIG. 14 is a detailed cross-sectional view broken away of a segment of the shoulder protector shown in FIGS. 1, 12 and 13.

FIG. 15 is a detailed cross-sectional view broken away showing a segment of the helmet and the foam pad inside the helmet.

DETAILED DESCRIPTION OF A PREFERRED EMBODIMENT

FIGS. 1 and 2 illustrate the major elements of my invention. In FIG. 1 a football player wears an articulated head, neck and shoulder protective device which includes a shoulder protector 4 held in place by a harness 22 and belt. As best shown in FIG. 2, the shoulder protector 4 includes an annular track 25 whose central opening is large enough to permit the player's head to pass through. Annular track 25 includes a plurality of spaced apart bearing mounts 9 shown in greater detail in FIG. 3. Each bearing mount 9 supports a roller bearing 8 preferably made of nylon or similar high strength plastic material.

A rotatable ring 3 is mounted on rollers 8. Ring 3 may be made in various vertical dimensions in order to "custom fit" my device to the height of the player. As best shown in FIG. 4, ring 3 has an annular groove in its bottom side into which fits the series of rollers 8, and as shown in FIGS. 4 and 5 track 25 and ring 3 are joined together by a C-shaped locking ring 15.

A helmet carrying housing 2 is mounted on ring 3 and helmet 1 is mounted on housing 2 by the arrangement best shown in FIGS. 6 and 7. Ring 3 contains two bifurcated upwardly projecting flanges 6 which with the assistance of locking tabs 7 and screws 16 are fitted into the two recessed slots in helmet carrying housing 2 where they are secured by a pair of locking screws 10 and locking screw retainers 11 which are shown in detail in FIG. 11. Helmet 1 contains two recessed portions 26 into which fit the upwardly projecting portions of housing 2.

Helmet 1 is mounted on helmet housing 2 so that it pivots on the center line of the helmet's ear holes 27. The helmet is attached to housing 2 preferably by two-piece fasteners 12 and 13 as shown in FIGS. 1 and 9 or by a one piece fastener 14 shown in FIG. 10, but in any event the fasteners must be hollow to allow the passage of sound into the helmet.

Helmet 1 includes a face mask 5 whose method of mounting onto the helmet is shown in FIG. 8. The helmet also includes foam padding 23 on its inside as shown in FIG. 15. Face mask 5 is preferably molded as a single piece of nylon or similar high strength plastic material and includes two elongated tabs 18 which fit into recesses 19 in helmet 1 and two eyelets 20 which are fastened into recesses 21 in the helmet by a pair of screws 17 as shown in FIG. 8.

FIGS. 12, 13 and 14 show cross-sectional views of my unique shoulder protector 4. The main body of protector 4 is molded of a suitable high strength light weight plastic such as fiber reinforced styrene into which are molded a plurality of flexible metal support rods 28 as shown in FIGS. 12 and 14. Those portions of the main body which cover the player's shoulders are lined with a layer of foam padding 24 shown in FIG. 13 but omitted from FIGS. 12 and 14. In order to provide both flexibility and ventilation, a series of openings 29 are provided in the main body and the layer of padding which lie in the grooves between the raised ridges on the protector as shown in FIG. 14.

In use, the football player wears the shoulder protector 4 and its harness 22 beneath a jersey, with the helmet carrying housing 2 and helmet 1 projecting out through the neck of the jersey. One or more inflatable annular or donut rings may be inserted within the helmet in order to fit the player's head snugly within the helmet.

Free motion of the player's head from side to side or up and down is provided by the rotatable retaining ring and the pivot pins mounting the helmet onto the helmet carrying housing. The impact of a head-on collision is absorbed by the player's shoulders rather than the player's neck and spine. Likewise, the impact of a blow to the side of the head is absorbed by the helmet, helmet housing, retaining ring and shoulder protector rather than the player's head and neck. My articulated device does not allow excessive sideways tilting or bending of the neck. Thus my device permits desirable movement of the player's head and neck while preventing those movements of the head and neck which can cause serious injury.

While I have shown and described a preferred embodiment of my head, neck and shoulder protective device, various modifications and rearrangements will be apparent to those skilled in the art. For example, retaining ring 3 and helmet housing 2 could be made as a single piece so that the helmet could then be readily disconnected from the helmet housing at the ear pivots. Also, a number of stops could be included to limit rotational movement within a desired range. No limitation of my invention should be implied by the foregoing description since the spirit and scope of my invention is set forth only in the appended claims.

I claim:

1. An articulated head, neck and shoulder protective device comprising a shoulder protector having a generally horizontal annular track at its center large enough for the wearer's head to pass through, and a helmet assembly rotatably mounted on the shoulder protector's annular track, the helmet assembly including a helmet carrying housing which rides on the annular track and which has two upwardly projecting and oppositely disposed flanges, and a helmet pivotally mounted on the two flanges of the helmet carrying housing.

2. An articulated head, neck and shoulder protective device comprising a shoulder protector having a generally horizontal annular track at its center large enough for the wearer's head to pass through, an annular ring rotatably mounted upon the shoulder protector's annular track, a helmet carrying housing affixed to the annular ring and having two upwardly projecting oppositely disposed flanges, and a helmet pivotably mounted on the two flanges of the helmet carrying housing.

3. An articulated head, neck and shoulder protective device as set forth in claim 1 wherein the shoulder protector's annular track includes a series of spaced apart conical rollers upon which the helmet assembly rotates.

4. An articulated head, neck and shoulder protective device as set forth in claim 2 wherein the shoulder protector's annular track includes a series of conical rollers spaced about the annular track and the annular ring has in its lower side an annular groove designed to fit into the rollers on the track.

5. An articulated head, neck and shoulder protective device as set forth in claim 4 wherein the annular track and the annular ring are joined together by a locking ring which is C-shaped in cross-section.

6. An articulated head, neck and shoulder protective device as set forth in claim 1 in which the helmet, the helmet carrying housing and the shoulder protector are made of fiber reinforced resin.

7. An articulated head, neck and shoulder protective device as set forth in claim 1 wherein the helmet is privotably mounted on the two flanges of the helmet carrying housing by a pair of hollow pivot pins.

* * * * *